US010907468B2

(12) United States Patent
Samuel

(10) Patent No.: US 10,907,468 B2
(45) Date of Patent: Feb. 2, 2021

(54) AUTOMATED WELLBORE TRAJECTORY CONTROL

(71) Applicant: Halliburton Energy Services, Inc., Houston, TX (US)

(72) Inventor: Robello Samuel, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 163 days.

(21) Appl. No.: 15/500,631

(22) PCT Filed: Sep. 3, 2014

(86) PCT No.: PCT/US2014/053866
§ 371 (c)(1),
(2) Date: Jan. 31, 2017

(87) PCT Pub. No.: WO2016/036360
PCT Pub. Date: Mar. 10, 2016

(65) Prior Publication Data
US 2017/0211372 A1 Jul. 27, 2017

(51) Int. Cl.
*E21B 44/00* (2006.01)
*E21B 7/04* (2006.01)
(Continued)

(52) U.S. Cl.
CPC ..... *E21B 47/022* (2013.01); *E21B 7/04* (2013.01); *E21B 44/00* (2013.01); *E21B 47/024* (2013.01); *E21B 47/09* (2013.01); *E21B 7/10* (2013.01)

(58) Field of Classification Search
CPC ... E21B 7/04; E21B 7/10; E21B 44/00; E21B 47/022; E21B 47/09
See application file for complete search history.

(56) References Cited

U.S. PATENT DOCUMENTS 6,101,444 A * 8/2000 Stoner ..... E21B 44/00 702/9
7,000,710 B1 2/2006 Umbach
(Continued)

FOREIGN PATENT DOCUMENTS

CA 2700258 A1 3/2009
CN 101868595 A 10/2010
(Continued)

OTHER PUBLICATIONS

Robello Samuel, A New Well-Path Design Using Clothoid Spiral (Curvature Bridging) for Ultra Extended-Reach Drilling, Sep. 2010, Society of Petroleum Engineers, 366-367 (Year: 2010).*
(Continued)

*Primary Examiner* — Robert E Fuller
*Assistant Examiner* — Lamia Quaim
(74) *Attorney, Agent, or Firm* — Benjamin Ford; Baker Botts L.L.P.

(57) ABSTRACT

The disclosed embodiments include a system, method, or computer-program product configured to performing automated wellbore trajectory control for correcting between an actual wellbore trajectory path and a planned wellbore trajectory path. For example, in one embodiment, a controller is configured to obtain real-time data gathered during the drilling operation, determine whether the actual wellbore trajectory path deviates from the planned wellbore trajectory path, and automatically initiate the wellbore trajectory control to change the actual wellbore trajectory path to a minimum-incremental wellbore energy correction path using provided correction constraints. The correction path may optionally include spline, catenary, circular arc, or clothoid curves.

20 Claims, 7 Drawing Sheets

(51) Int. Cl.

| | |
|---|---|
| ***E21B 47/022*** | (2012.01) |
| ***E21B 47/024*** | (2006.01) |
| ***E21B 47/09*** | (2012.01) |
| *E21B 7/10* | (2006.01) |

(56) References Cited

U.S. PATENT DOCUMENTS

| | | | | |
|---|---|---|---|---|
| 2003/0024738 | A1 | 2/2003 | Schuh | |
| 2009/0090555 | A1* | 4/2009 | Boone | E21B 44/02 175/45 |
| 2010/0241289 | A1 | 9/2010 | Sanberg | |
| 2011/0172976 | A1 | 7/2011 | Budiman et al. | |
| 2011/0213601 | A1 | 9/2011 | Pirovolou | |
| 2012/0285701 | A1 | 11/2012 | Cheng et al. | |
| 2015/0330209 | A1* | 11/2015 | Panchal | E21B 7/04 700/275 |

FOREIGN PATENT DOCUMENTS

| | | | |
|---|---|---|---|
| CN | 102900366 | A | 1/2013 |
| WO | 2012173601 | A1 | 12/2012 |
| WO | 2013032652 | A1 | 3/2013 |
| WO | 2014091462 | A1 | 6/2014 |
| WO | 2015112160 | A1 | 7/2015 |

OTHER PUBLICATIONS

Search report issued in related GB application No. GB1700033.2 dated Mar. 29, 2018, 4 pages.

International Preliminary Report on Patentability issued in related Application No. PCT/US2014/053866, dated Mar. 16, 2017 (12 pages).

Jha, Kailash. "Energy Based Approximation and Interactive Updaing of Geological Structures and Well-Paths for Real Time Monitoring."

Mills, Steven John. Visual guidance for fixed-wing unmanned aerial vehicles using feature tracking: application to power line inspection. Diss. Queensland University of Technology, 2013.

Agbaji, Armstrong Lee. Development of an algorithm to analyze the interrelationship among five elements involved in the planning, design and drilling of extended reach and complex wells. Diss. The Pennsylvania State University, 2009.

Samuel, G. Robello, and Xiushan Liu. Advanced Drilling Engineering: Principles and Designs. Gulf Pub., 2009.

International Search Report and Written Opinion issued in related PCT Application No. PCT/US2014/053866 dated Jun. 5, 2015, 15 pages.

Lancaster, Don, "Cubic Spline Approximations to a Catenary Curve" from http://www.tinaja.com/, 5 pages, 2006.

Search report issued in related Chinese application No. CN 201480080929.8, dated Mar. 5, 2019, 16 pages, with translation.

* cited by examiner

AUTOMATED WELLBORE TRAJECTORY CONTROL

CROSS-REFERENCE TO RELATED APPLICATION

The present application is a U.S. National Stage Application of International Application No. PCT/US2014/053866 filed Sep. 3, 2014, which is incorporated herein by reference in its entirety for all purposes.

BACKGROUND OF THE INVENTION

The invention relates generally to methods of directionally drilling wells, particularly wells for the production of hydrocarbon products. More specifically, it relates to methods and systems for performing automated control of a steerable drilling tool to drill wells along a planned trajectory.

At the beginning of a drilling operation, drillers typically establish a drilling plan that includes a target location and a drilling path to the target location. During the drilling operation, it is not uncommon that the actual wellbore trajectory deviates from the planned well path due to unexpected reasons. Action must be taken to bring the wellbore trajectory back to the desired path. This deviation correction mechanism is extremely important for any drilling operation.

BRIEF DESCRIPTION OF THE DRAWINGS

Illustrative embodiments of the present invention are described in detail below with reference to the attached drawing figures, which are incorporated by reference herein and wherein.

Figure 1:
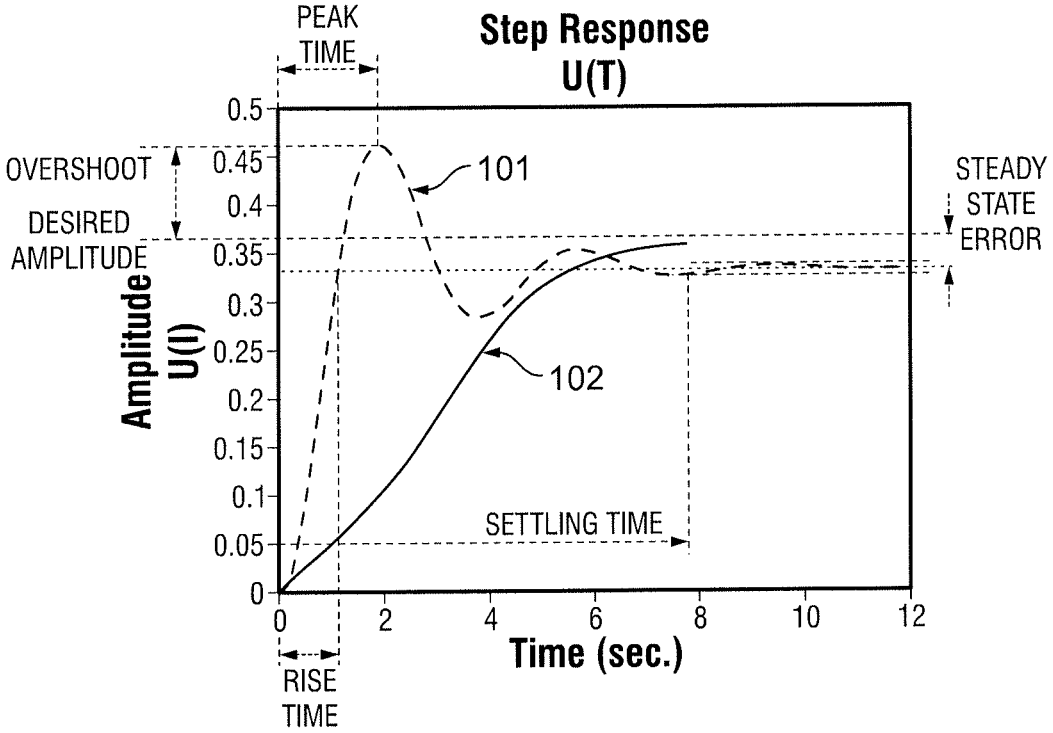
FIG. 1 is a diagram illustrating the feedback signal of a proportional-integral-derivative controller for wellbore trajectory control, according to aspects of the present disclosure.

The illustrated figures are only exemplary and are not intended to assert or imply any limitation with regard to the environment, architecture, planned, or process in which different embodiments may be implemented.

DETAILED DESCRIPTION

The invention relates generally to methods of directionally drilling wells, particularly wells for the production of hydrocarbon products. More specifically, it relates to methods and systems for performing automated control of a steerable drilling tool to drill wells along a planned trajectory.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or a direct connection. Thus, if a first device couples to a second device, that connection may be through a direct connection, or through an indirect electrical or mechanical connection via other devices and connections. The term "upstream" as used herein means along a flow path towards the source of the flow, and the term "downstream" as used herein means along a flow path away from the source of the flow. The term "uphole" as used herein means along the drill string or the hole from the distal end towards the surface, and "downhole" as used herein means along the drill string or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory ("RAM"), one or more processing resources such as a central processing unit ("CPU") or hardware or software control logic, ROM, and/or other types of nonvolatile memory. The information handling system may further include a microcontroller, which may be a small computer on a single integrated circuit containing a processor core, memory, and programmable input/output peripherals. Additional components of the information handling system may include one or more disk drives, one or more network ports for communication with external devices as well as various input and output ("I/O") devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory ("EEPROM"), and/or flash memory; as well as communications media such as wires.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near-surface construction purposes or borehole u-tube pipelines used for the transportation of fluids such as hydrocarbons. Embodiments described below with respect to one implementation are not intended to be limiting.

As stated above, during the drilling process, it is not uncommon that the actual wellbore trajectory deviates from the planned well path due to unexpected reasons. Currently, conventional wellbore trajectory control methods use a proportional-integral-derivative (PID) controller for wellbore trajectory control. A PID controller calculates an "error" value as the difference between a measured process variable and a desired setpoint. The controller attempts to minimize the error by adjusting the process control outputs. In a PID method, the feedback signal is a function with proportional, integral, and derivative parts. The signal usually fluctuates before it returns to the desired value as indicated by signal 101 in FIG. 1. In down-hole drilling, it is desired to avoid the trajectory fluctuation. In order to achieve a smooth signal correction 102, as indicated in FIG. 1, the coefficients of the proportional, integral, and derivative parts have to be carefully tuned. However, it is difficult to realize or achieve the smooth control signal 102 using the PID method because the pre-tuned coefficients may not work due to the changing down-hole operation conditions.

Accordingly, the disclosed embodiments present a system, method, or computer-program product that may replace or modify the conventional PID controller to implement a minimum wellbore energy method for performing automated wellbore trajectory control. The disclosed embodiments may correct between an actual wellbore trajectory path and a planned wellbore trajectory path using correction paths that satisfy connection constraints and that may include spline, catenary, circular arc, or clothoid curves. The disclosed embodiments may optionally be implemented on a model-predictive controller rather than a PID-type controller.

In accordance with the disclosed embodiments, information gathering may be performed using tools that are delivered downhole via wireline or alternatively using tools that are coupled to or integrated into a drill string of a drilling rig. As will be further described below in referenced to the figures, wireline-delivered tools are suspended from a wireline that is electrically connected to control and logging equipment at the surface of the well. The tools may be deployed by first removing the drill string and then lowering the wireline and tools to an area of interest within the formation. This type of testing and measurement is often referred to as "wireline formation testing (WFT)." The tools associated with WFT may be used to measure pressure and temperature of formation and wellbore fluids.

In certain embodiments, instead of wireline deployment, measurement tools are coupled to or integrated with the drill string. In these situations, the added expense and time of removing the drill string prior to measurement of important formation properties is avoided. This process of "measurement while drilling (MWD)" uses measurement tools to determine formation and wellbore temperatures and pressures, as well as the trajectory and location of the drill bit. The process of "logging while drilling (LWD)" uses tools to determine additional formation properties such as permeability, porosity, resistivity, and other properties. The information obtained by MWD and LWD enable real-time decisions to be made to alter ongoing drilling operations.

Figure 2:
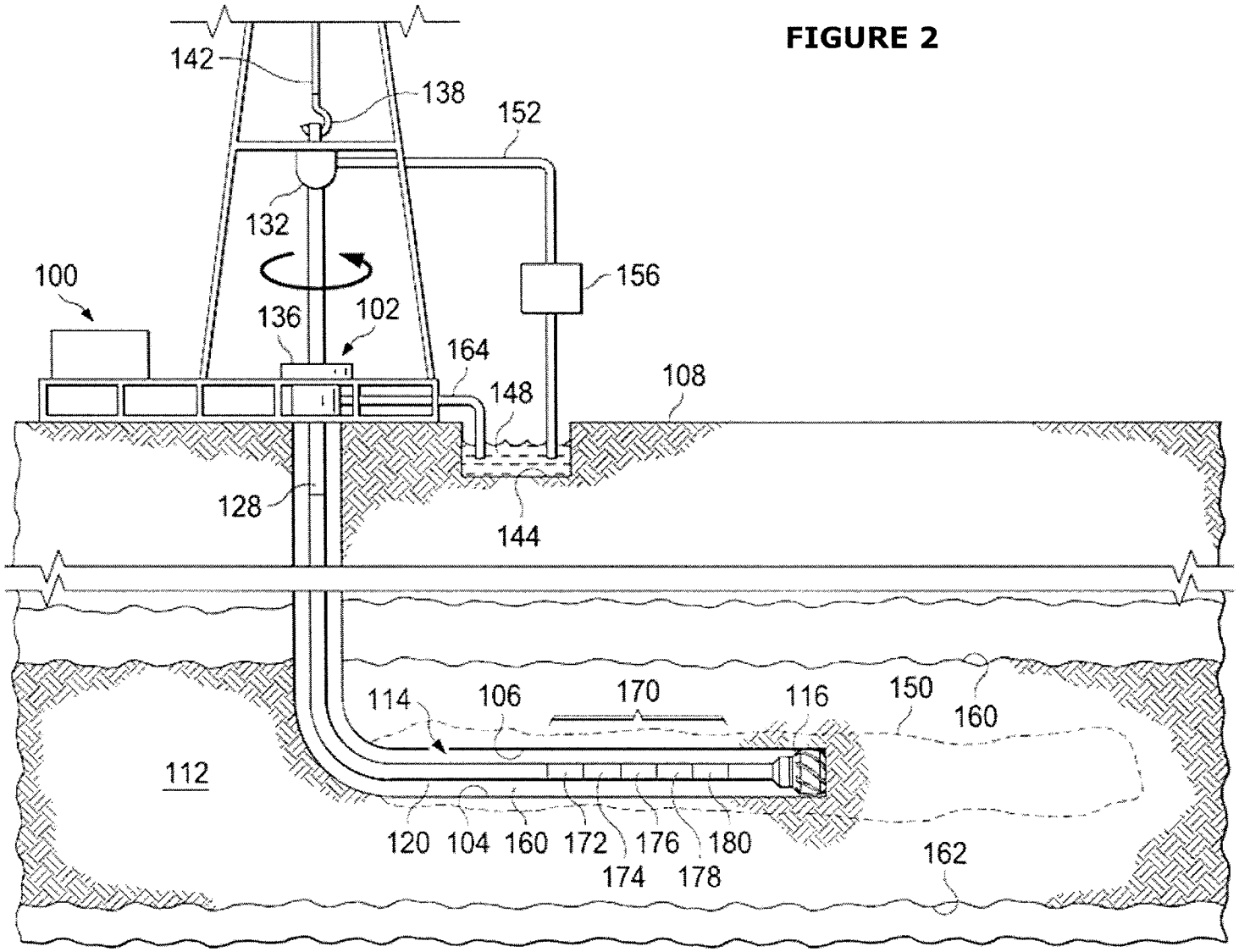
FIG. 2 illustrates a schematic view of a well that utilizes a measurement-while-drilling-assembly for determining real-time path data, according to aspects of the present disclosure.
Figure 3:
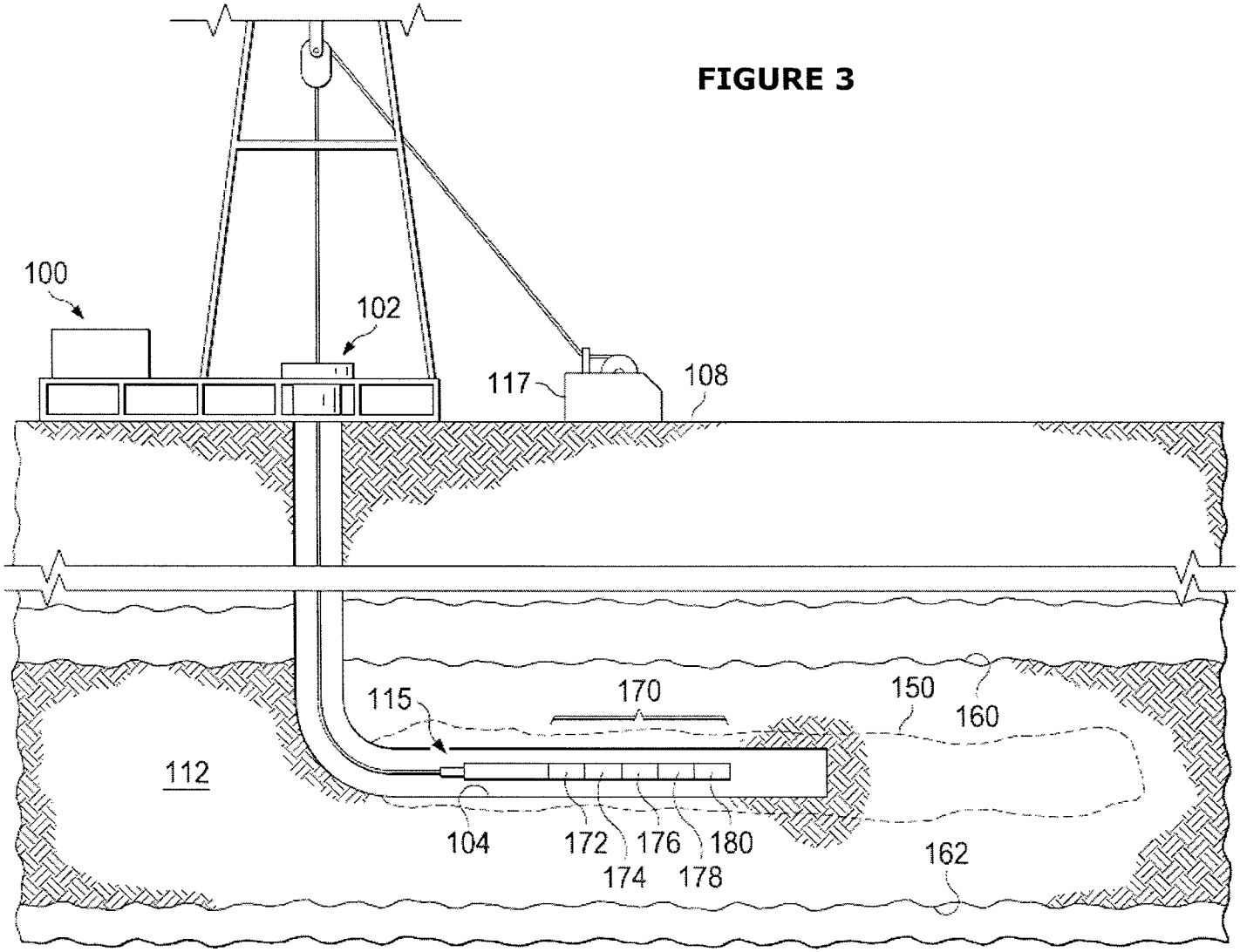
FIG. 3 illustrates a schematic view of a well that has a wireline or wireline formation testing assembly for determining real-time path data, according to aspects of the present disclosure.
Figure 4:
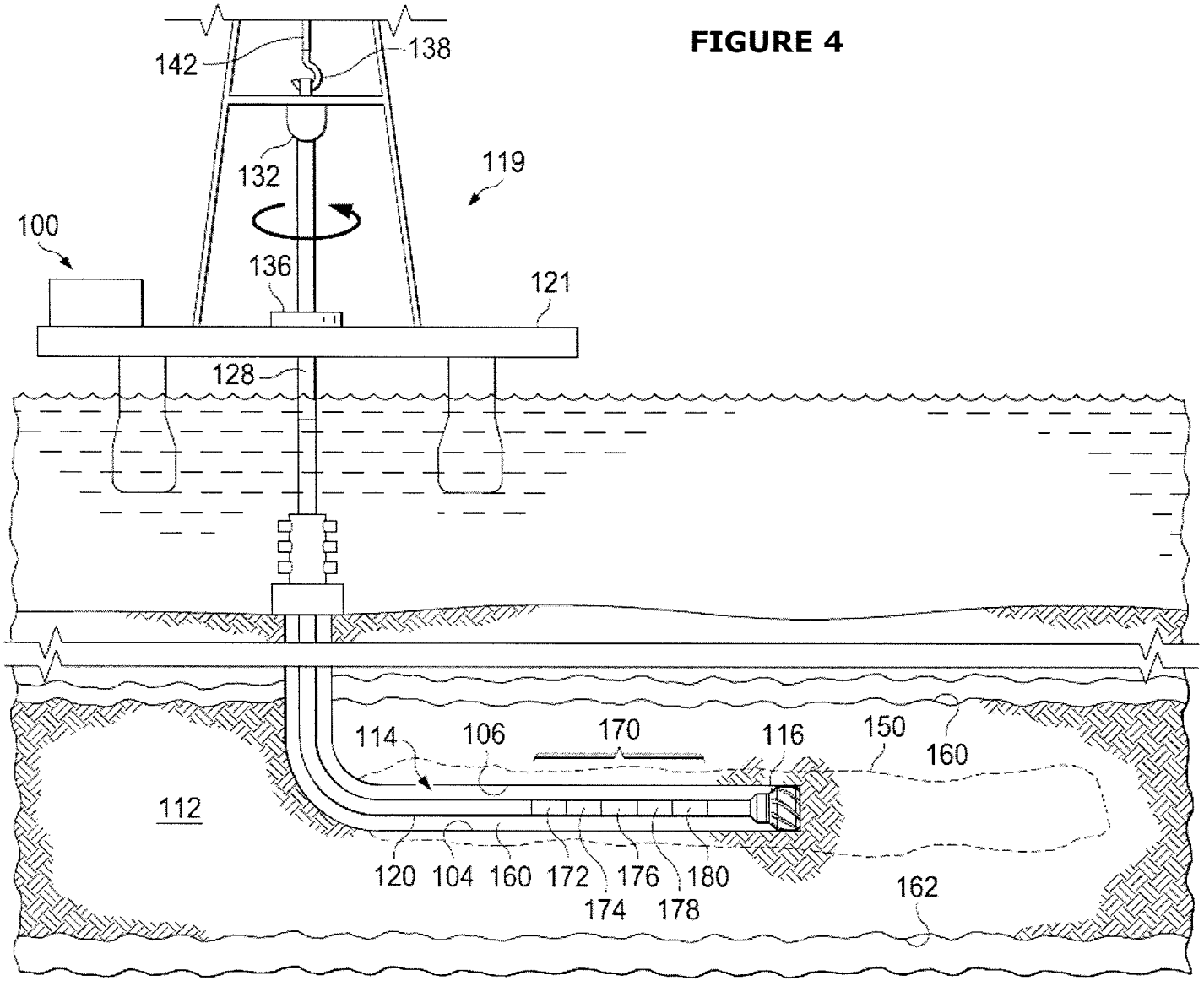
FIG. 4 illustrates a schematic view of a subsea well that utilizes a logging-while-drilling assembly for determining real-time path data, according to aspects of the present disclosure.

FIGS. 2-4 illustrates several example embodiments of well systems in which the disclosed embodiments may be utilized. For example, beginning with FIG. 2, a schematic view of a well 102 that utilizes a measurement while drilling assembly for determining real-time path data in accordance with a disclosed embodiment is presented. In the depicted embodiment, the well 102 is illustrated onshore with a set of measurement tools 170 being deployed in a bottom hole assembly (BHA) 114. The well 102 includes a wellbore 104 that extends from a surface 108 of the well 102 to or through a subterranean formation 112. The well 102 is formed by a drilling process, in which a drill bit 116 is turned by a drill string 120 that extends from the drill bit 116 to the surface 108 of the well 102. The drill string 120 may be made up of one or more connected tubes or pipes, of varying or similar cross-section. The drill string may refer to the collection of pipes or tubes as a single component, or alternatively to the individual pipes or tubes that comprise the string. The term drill string is not meant to be limiting in nature and may refer to any component or components that are capable of transferring rotational energy from the surface of the well to the drill bit. In several embodiments, the drill string 120 may include a central passage disposed longitudinally in the drill string and capable of allowing fluid communication between the surface of the well and downhole locations.

At or near the surface 108 of the well, the drill string 120 may include or be coupled to a kelly 128. The kelly 128 may have a square, hexagonal or octagonal cross-section. The kelly 128 is connected at one end to the remainder of the drill string and at an opposite end to a rotary swivel 132. The kelly passes through a rotary table 136 that is capable of rotating the kelly and thus the remainder of the drill string 120 and drill bit 116. The rotary swivel 132 allows the kelly 128 to rotate without rotational motion being imparted to the rotary swivel 132. A hook 138, cable 142, traveling block (not shown), and hoist (not shown) are provided to lift or lower the drill bit 116, drill string 120, kelly 128 and rotary swivel 132. The kelly and swivel may be raised or lowered as needed to add additional sections of tubing to the drill string 120 as the drill bit 116 advances, or to remove sections of tubing from the drill string 120 if removal of the drill string 120 and drill bit 116 from the well 102 are desired.

A reservoir 144 is positioned at the surface 108 and holds drilling mud 148 for delivery to the well 102 during drilling operations. A supply line 152 is fluidly coupled between the reservoir 144 and the inner passage of the drill string 120. A pump 156 drives fluid through the supply line 152 and downhole to lubricate the drill bit 116 during drilling and to carry cuttings from the drilling process back to the surface 108. After traveling downhole, the drilling mud 148 returns to the surface 108 by way of an annulus 160 formed between the drill string 120 and the wellbore 104. At the surface 108, the drilling mud 148 is returned to the reservoir 144 through a return line 164. The drilling mud 148 may be filtered or otherwise processed prior to recirculation through the well 102.

In one embodiment, the set of measurement tools 170 is positioned downhole to measure, process, and communicate data regarding the physical properties of the subterranean formation 112 such as, but not limited to, permeability, porosity, resistivity, and other properties. The measurement tools 170 may also provide information about the drilling process or other operations occurring downhole. In some embodiments, the data measured and collected by the set of measurement tools 170 may include, without limitation, pressure, temperature, flow, acceleration (seismic and acoustic), strain data, and location and trajectory data of a drill bit 116.

The set of measurement tools 170 may include a plurality of tool components that are coupled to one another by threads, couplings, welds, or other means. In the illustrative embodiment depicted in FIG. 3, the set of measurement tools 170 includes a transceiver unit 172, a power unit 174, a sensor unit 176, a pump unit 178, and a sample unit 180. Each of the individual components may include control electronics such as processor devices, memory devices, data storage devices, and communications devices, or alternatively a centralized control unit may be provided that communicates with and controls one or more of the individual components.

The transceiver unit 172 is capable of communicating with the control system 100 or similar equipment at or near the surface 108 of the well 102. Communication between the transceiver unit 172 and the control system 100 may be by wire if the drill string 120 is wired or if a wireline evaluation system is deployed. Alternatively, the transceiver unit 172 and control system 100 may communicate wirelessly using mud pulse telemetry, electromagnetic telemetry, or any other suitable communication method. Data transmitted by the transceiver unit 172 may include without limitation sensor data or other information, as described above, measured by the various components of the set of measurement tools 170.

The power unit 174 may be hydraulically powered by fluid circulated through the well or by fluid circulated or pressurized in a downhole, closed-loop hydraulic circuit. Alternatively, the power unit 174 may be an electrical power unit, an electro-mechanical power unit, a pneumatic power unit, or any other type of power unit that is capable of harnessing energy for transfer to powered devices. The power unit 174 may provide power to one or more of the components associated with the set of measurement tools 170, or alternatively to one or more other downhole devices. For example, in some embodiments, the power unit 174 may provide power to the pump unit 178. A pump associated with the pump unit 178 may be used to move fluids within or between the components of the set of measurement tools 170 as explained in more detail below.

The sensor unit 176 may also receive power from the power unit 174 and may contain a number of sensors such as pressure sensors, temperature sensors, seismic sensors, acoustic sensors, strain gauges, inclinometers, or other sensors. Additionally, the sample unit 180 may gather samples of the subterranean formation 112 or reservoir fluids (typically hydrocarbons) for enabling further evaluation of the drilling operations and production potential.

As will be further described, the information gathered by the set of measurement tools 170 during the drilling process allows the control system 100 to update a probability model for automatically making adjustments in a drill path.

While the set of measurement tools 170 is illustrated as a part of the drill string 120 in FIG. 2, in other embodiments, as depicted in FIG. 3, the set of measurement tools 170 may be lowered into the well by wireline either through the central passage of the drill string 120, or if the drill string 120 is not present, directly through the wellbore 104. In this embodiment, set of measurement tools 170 may instead be deployed as part of a wireline assembly 115, either onshore or off-shore. The wireline assembly 115 includes a winch 117 to lift and lower a downhole portion of the wireline assembly 115 into the well.

In still another embodiment, as depicted in FIG. 4, the control system 100 and the set of measurement tools 170 may similarly be deployed in a sub-sea well 119 accessed by a fixed or floating platform 121.

Figure 5:
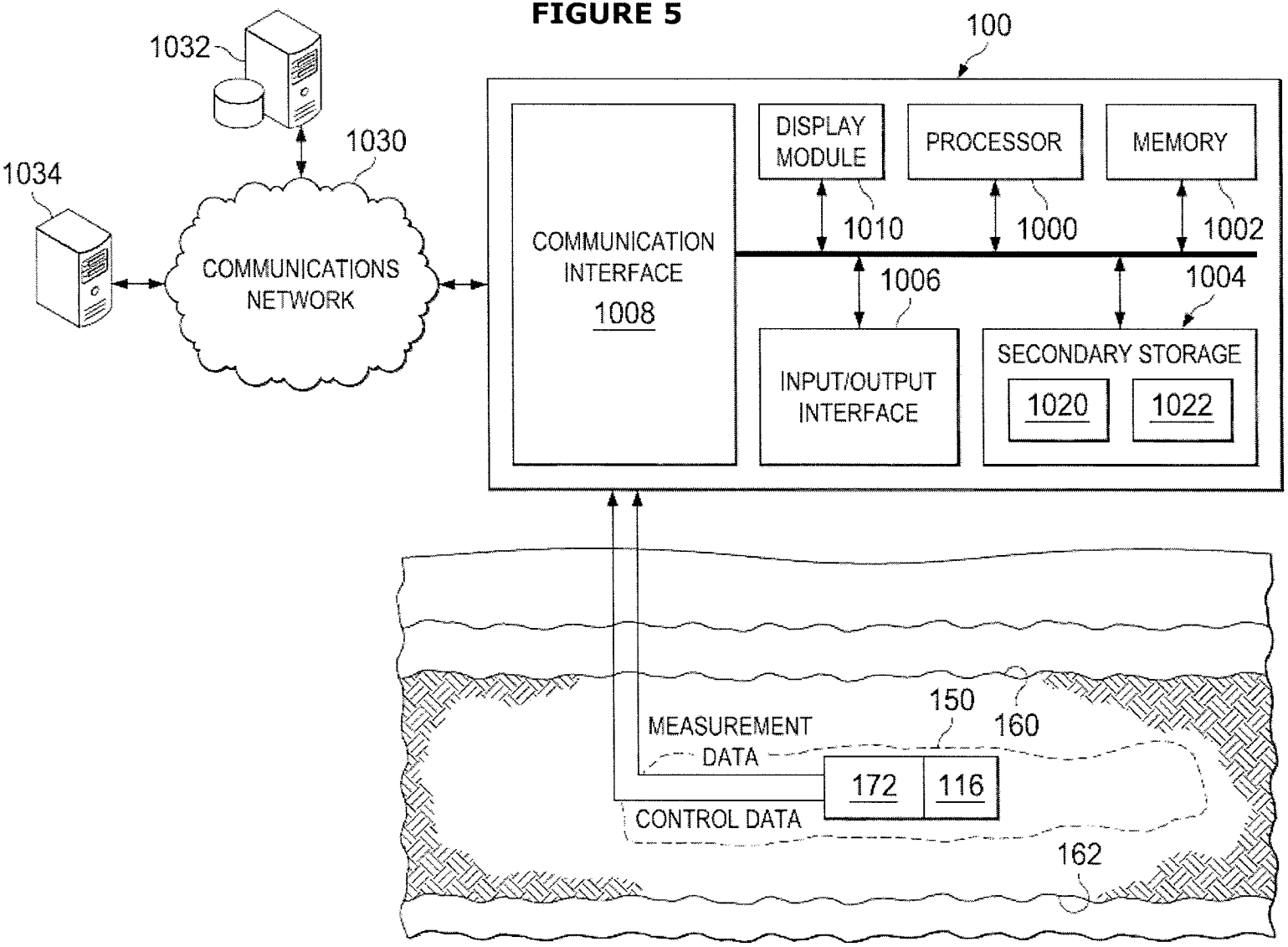
FIG. 5 is a block diagram illustrating one embodiment of a control system, according to aspects of the present disclosure.

FIG. 5 is a block diagram illustrating one embodiment of the control system 100 for implementing the features and functions of the disclosed embodiments. The control system 100 includes, among other components, a processor 1000, memory 1002, secondary storage unit 1004, an input/output interface module 1006, and a communication interface module 1008. The processor 1000 may be any type or any number of single core or multi-core processors capable of executing instructions for performing the features and functions of the disclosed embodiments.

The input/output interface module 1006 enables the control system 100 to receive user input (e.g., from a keyboard and mouse) and output information to one or more devices such as, but not limited to, printers, external data storage devices, and audio speakers. The control system 100 may optionally include a separate display module 1010 to enable information to be displayed on an integrated or external display device. For example, the display module 1010 may include instructions or hardware (e.g., a graphics card or chip) for providing enhanced graphics, touchscreen, and/or multi-touch functionalities associated with one or more display devices.

Main memory 1002 is volatile memory that stores currently executing instructions/data or instructions/data that are prefetched for execution. The secondary storage unit 1004 is non-volatile memory for storing persistent data. The secondary storage unit 1004 may be or include any type of internal or external data storage component such as a hard drive, a flash drive, or a memory card. In one embodiment, the secondary storage unit 1004 stores the computer executable code/instructions and other relevant data for enabling a user to perform the features and functions of the disclosed embodiments.

For example, in accordance with the disclosed embodiments, the secondary storage unit 1004 may permanently store, among other data, the executable code/instructions of an automated wellbore trajectory control algorithm 1020 as will be further described herein. The instructions associated with the automated wellbore trajectory control algorithm 1020 are loaded from the secondary storage unit 1004 to main memory 1002 during execution by the processor 1000 for performing the features of the disclosed embodiments. In some embodiments, the secondary storage unit 1004 may also include executable code/instructions associated with a formation/reservoir modeling application, such as, but not limited to, DecisionSpace® Earth Modeling software 1022 available from Landmark Graphics Corporation for assisting in controlling the wellbore trajectory.

The communication interface module 1008 enables the control system 100 to communicate with the communications network 1030. For example, the network interface module 1008 may include a network interface card and/or a wireless transceiver for enabling the control system 100 to send and receive data through the communications network 1030 and/or directly with other devices.

The communications network 1030 may be any type of network including a combination of one or more of the following networks: a wide area network, a local area network, one or more private networks, the Internet, a telephone network such as the public switched telephone network (PSTN), one or more cellular networks, and wireless data networks. The communications network 1030 may include a plurality of network nodes (not depicted) such as routers, network access points/gateways, switches, DNS servers, proxy servers, and other network nodes for assisting in routing of data/communications between devices.

For example, in one embodiment, the control system 100 may interact with one or more servers 1034 or databases 1032 for performing the features of the disclosed embodiments. For example, the control system 100 may query the database 1032 for well log information or other geophysical data for generating an initial model of a formation and reservoir in accordance with the disclosed embodiments. Further, in certain embodiments, the control system 100 may act as a server system for one or more client devices or a peer system for peer to peer communications or parallel processing with one or more devices/computing systems (e.g., clusters, grids).

In addition, control system 100 may communicate data to the transceiver unit 172 such as control data to direct the operation of the various components of the set of measurement tools 170 and/or to alter direction of the drill path based on a change in a probability model in accordance with the disclosed embodiments. As described above, the control system 100 is also configured to receive real-time measurement data for the set of measurement tools 170 during the drilling process for performing the automated wellbore trajectory control as described herein.

Still, in certain embodiments, the communication path between the control system 100 and the transceiver unit 172 may involve one or more middleware devices. For example, in some embodiments, the control system 100 may be a remote system that communicates with a local system located at a well site over the communications network 1030, the local system being in direct communication with the transceiver unit 172. In other embodiments, the transceiver unit 172 may be in direct communication with one or more devices located on the communications network 1030 as opposed to communicating with a local system at the well site.

Figure 6:
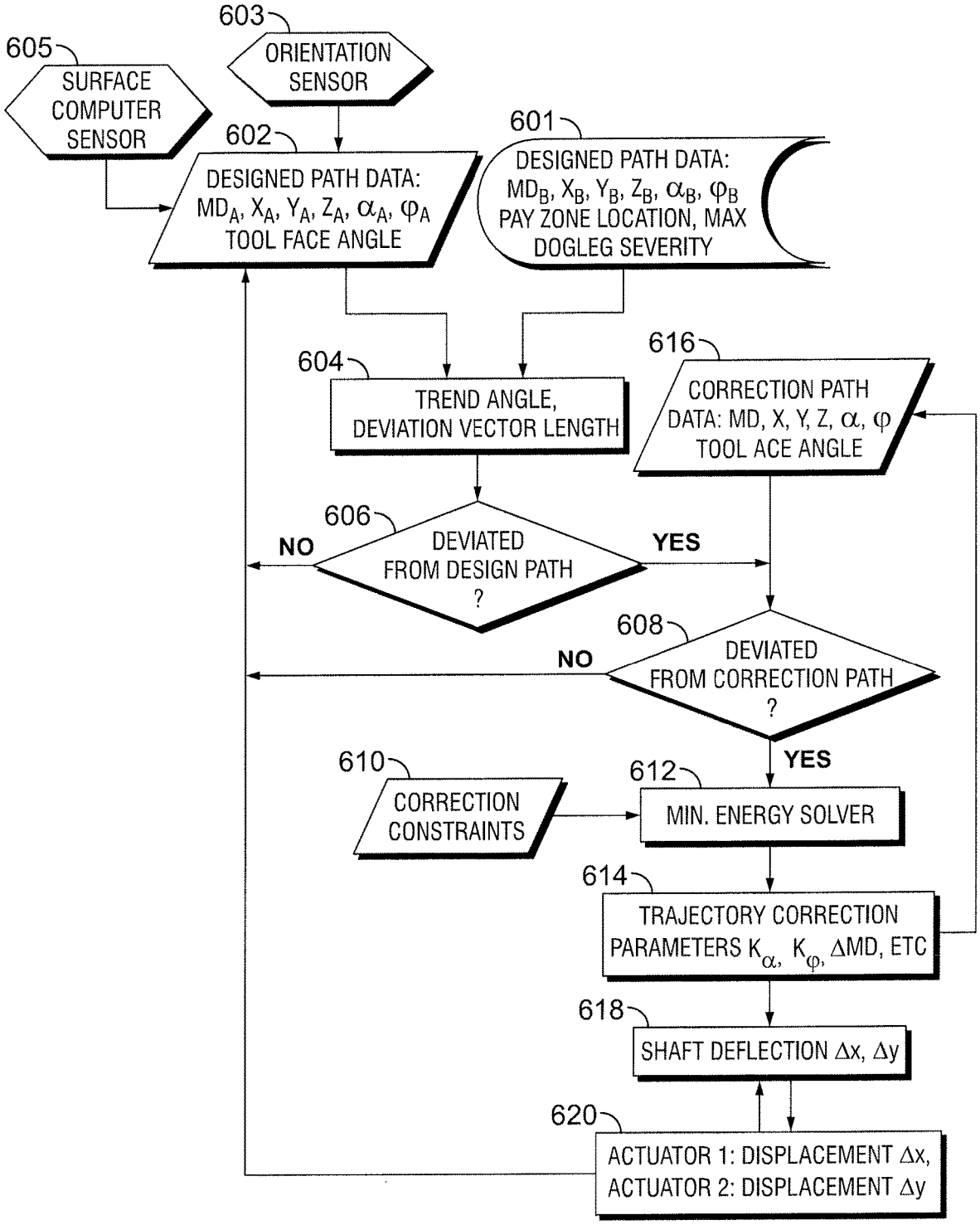
FIG. 6 is a flow diagram depicting a method for performing automated trajectory control, according to aspects of the present disclosure.

With reference now to FIG. 6, a flow diagram is presented that illustrates an embodiment of a process 600 for performing automated wellbore trajectory control for correcting between an actual wellbore trajectory path and a planned wellbore trajectory path. The process 600 may be implemented by a control system as described above or on a PID or model-predictive controller having memory, logic, and at least one processor for executing instructions that performs the operations of the process 600.

The process 600 begins at step 602 by receiving real-time path data from the surface computer sensor(s) 605 and orientation sensor(s) 603 as described above in reference to FIGS. 2-5. Examples of the real-time path data that is received includes, but is not limited to, measured depth ($MD_A$), horizontal departure along south-north direction ($X_A$), horizontal departure along west-east direction ($Y_A$), true vertical depth ($Z_A$), inclination angle ($\alpha_A$), azimuth angle ($\varphi_A$), and tool face angle. The subscript A indicates that the parameters are taken at position/location A. In addition, the process at step 601 receives the parameters/data of the planned path including, but not limited to, $MD_B$, $X_B$, $Y_B$, $Z_B$, $\alpha_B$, $\varphi_B$, pay zone location, and maximum dogleg severity. The subscript B indicates that the parameters refer to position B.

Figure 7:
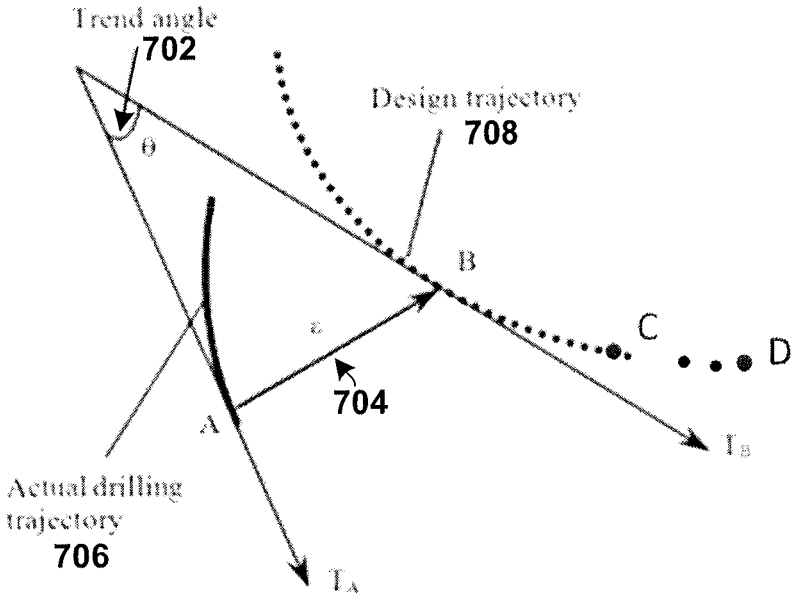
FIG. 7 is a diagram depicting a trend angle and a deviation vector length between an actual drilling path and a planned drilling path, according to aspects of the present disclosure.

At step 604, the process determines a trend angle 702 and a deviation vector length 704 as illustrated in FIG. 7 between the actual drilling path/trajectory 706 and the planned drilling path/trajectory 708. The process at step 606 determines based on the trend angle 702 and the deviation vector length 704 whether the actual drilling path 706 has deviated from the planned drilling path 708. For example, in certain embodiments, a deviation threshold parameter may be set by a drilling operator to determine whether the actual drilling path 706 has deviated from the planned drilling path 708. In this way, the drilling operator may configure the system such that minor deviations within a set toleration range do not invoke the steps for determining a correction path discussed below.

If the process determines that the actual drilling path 706 has not deviated from the planned drilling path 708, the process returns to step 602 and repeats with updated real-time drill path data. However, if the process determines that the actual drilling path 706 has deviated from the planned drilling path 708, the process determines at step 608 whether the actual drilling path 706 has deviated from a correction path. A correction path is a path previously determined by the process that would bring the actual drilling path 706 back in line with the planned drilling path 708. If the process determines that the actual drilling path 706 has not deviated from a correction path, the process returns to step 602 and repeats with updated real-time drill path data.

However, if the process determines that either the actual drilling path 706 has deviated from a correction path or that the actual drilling path 706 is not currently on a correction path (e.g., this would occur when the process previously considered the actual drilling path 706 to be aligned with the planned drilling path 708), the process receives correction constraints at step 610 and executes, at subroutine 612, a minimum energy algorithm/solver to determine the parameters of a correction path that has a minimum incremental wellbore energy. A correction path is a drilling path that connects from the end of the actual drilling path 706 to a target intersection point on the planned drilling path 708 so that drilling on the planned drilling path may resume. As would be appreciated by those of ordinary skill in the art, having the benefit of the present disclosure, the present methods and systems are not limited to any particular type of correction constraints. Accordingly, the correction constraints may be any suitable type known to those of ordinary skill in the art, without departing from the scope of the present disclosure.

The normalized wellbore energy for a correction path is determined based on the following equations (assuming trajectory correction starts at the beginning of $\Delta D_{n-1}$):

$$E_{(abs)n} = \frac{\sum_{i=1}^{n} (\kappa_i^2 + \tau_i^2)\Delta D_i}{D_N + \Delta D_N}$$

$$\tau_i = \frac{\kappa_{\alpha i}\dot{\kappa}_{\varphi i} - \kappa_{\varphi i}\dot{\kappa}_{\alpha i}}{\kappa_i^2}\sin\alpha_i + \kappa_{\varphi i}\left(1 + \frac{\kappa_{\alpha i}^2}{\kappa_i^2}\right)\cos\alpha_i$$

$\kappa_i = \beta/\Delta D_i = \arccos(\cos \Delta\varphi_{i-1} \sin \alpha_i \cos \alpha_{i-1})/\alpha D_i$ or $\kappa_i = \sqrt{\kappa_{\alpha i}^2 + \alpha_{\varphi i}^2 \sin^2\alpha_i}$ $\alpha_i = \alpha_{i-} + \kappa_{\alpha i}\Delta D_i, \Delta\varphi_i = \kappa_{\varphi i}\Delta D_i$ for i=1, 2, . . . , n−2, where $\kappa_{\alpha i}$ and $\kappa_{\varphi i}$ are known;

for i=n−1,n,$\Delta D_i$, where $\kappa_{\varphi i}$ are unknown

Where $D_i$ is the measured depth, $\alpha_{i-1}$ is the inclination angle, $\alpha_i$ is the new inclination angle, $\beta$ is the overall angle change, $\kappa$ is the wellbore curvature, $\tau$ is the borehole torsion, $\Delta_\varphi$is change of azimuth, $\kappa_\alpha$ is rate of inclination change, $\kappa_\varphi$ is the rate of azimuth change.

The correction constraints received at step 610 may specify limits on allowable correction paths. In certain embodiments, the correction constraints may specify a maximum rate of curvature value. For example, the correction constraints may set a maximum rate of inclination change ($\kappa_\alpha$) and a maximum rate of azimuth change ($\kappa_\varphi$) of less than 10 degrees per 100 feet. The correction constraints may additionally or alternatively specify a minimum and/or maximum length of deviation from the planned drilling path. The length may be specified in terms of vertical depth deviation (i.e., Z-axis deviation), lateral deviation (i.e., X- or Y-axis deviations), and/or total deviation (i.e., the length of the correction path until it rejoins the planned drilling path). For example, the correction constraints may specify that the correction path should merge back to the planned drilling path 708 in 100 to 1000 feet and should not go more than 250 feet below the depth of the planned drilling path 708 or deviate laterally more than 500 feet. The correction constraints may optionally set a specific target point or range of target points for intersecting the planned drilling path 708 with the correction path. In certain embodiments, the correction constraints may also specify a tolerance for deviation from the planned drilling path such that the correction path may not be required to precisely rejoin the planned drilling path.

The selection of correction constraints at step 610 may depend on wellsite characteristics. For example, curvature constraints may be selected based on drillstring capabilities to ensure that the correction path may feasibly be drilled. Depth or lateral deviation constraints may be selected to prevent drilling a correction path through geologically sensitive formations. Total deviation constraints may be selected based on the desired length of the drilling path. The correction constraints may be determined at the time needed (e.g., at step 608 when a deviation is detected) or may be predetermined before that time. Further, the correction constraints may be provided by a wellsite operator or may be automatically determined without operator intervention.

After correction constraints are received at step 610, the process executes, at subroutine 612, a minimum energy algorithm/solver to determine the parameters of a correction path that has a minimum incremental wellbore energy satisfying the correction constrains. This subroutine may be implemented in a number of ways; one embodiment is shown in FIG. 8 and discussed below.

Based on the results of the minimum energy algorithm/solver, the process at step 614 determines the trajectory correction parameters such as, but not limited to, rate of inclination change ($\kappa_\alpha$), rate of azimuth change ($\kappa_{100}$), and change in measured depth ($\Delta$MD). The process updates the correction path data at step 616. At step 618, the process determines the vertical $\Delta y$ and horizontal $\Delta x$ shaft deflection. The process then initiates the actuator(s) at step 620 to perform the displacement based on the determined shaft deflection, with the process repeating at step 602.

Figure 8:
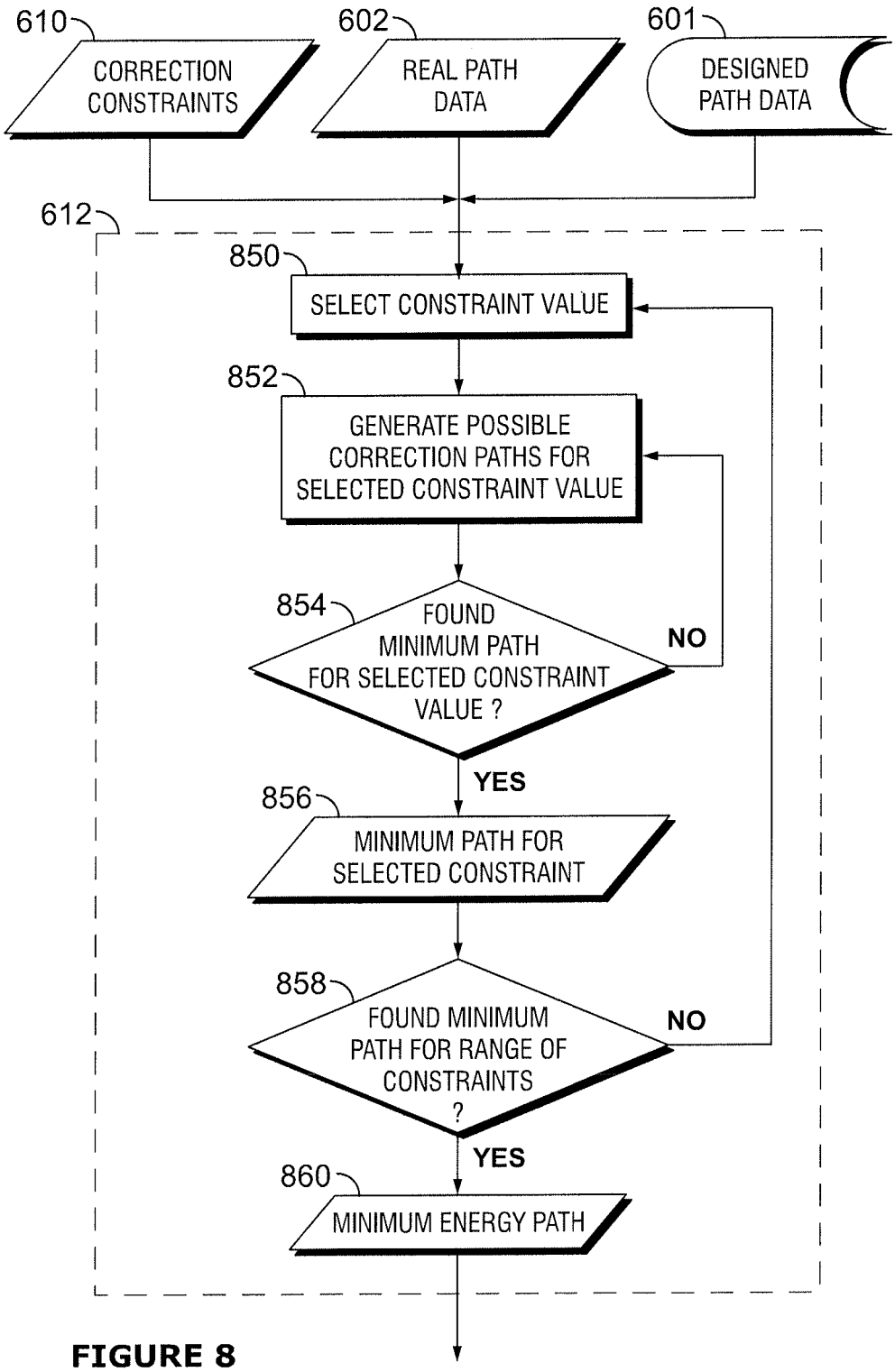
FIG. 8 is a flow diagram depicting a minimum energy algorithm/solver process, according to aspects of the present disclosure.

FIG. 8 is a flow diagram that illustrates one embodiment of minimum energy algorithm/solver process 612. Steps 850, 852, 854, 856, and 858 illustrate an double-iteration loop for determining a minimum-energy correction path from actual drilling path 706 to planned drilling path 708 that satisfies the connection constraints received at 610. At the conclusion of the iteration loop, the determined minimum-energy correction path may be provided at step 860 to trajectory correction step 614.

The process begins at step 850, where it may receive the planned path data 601, the real-time path data 602, and the correction constraints 610 (all discussed above with respect to FIG. 6). At step 850, the process may select a particular correction constraint value for which to determine a minimum-energy correction path. For example, if the correction constraints 610 specify a total deviation length range of 100 to 1000 feet, at step 850 a specific total deviation length within that range (e.g., 100 feet) may be selected.

Steps 852 and 854 illustrate an iteration sub-loop for generating a plurality of candidate correction paths that satisfy the specific connection constraint value selected at step 850 (e.g., 100 feet of total deviation) and then determining a minimum-energy correction path for that specific connection constraint value from among the candidate correction paths (e.g., the minimum-energy correction path with a total deviation of 100 feet). The minimum-energy correction path determined by the iteration loop of steps 852 and 854 may be provided at step 856.

At step 858, the minimum-energy correction paths provided at step 856 are evaluated to decide whether a final minimum-energy correction path has been determined. If a final minimum-energy correction path has been determined at step 858, it may be provided at step 860 to trajectory correction step 614. If a final minimum-energy correction path has not been determined at step 858, the process may loop back to step 850 and repeat the iteration loop by selecting a new correction constraint value (e.g., total deviation of 110 feet). The process may then repeat steps 852, 854, 856, and 858 based on that new correction constraint value.

The iteration sub-loop of steps 852 and 854 begins at step 852, where a candidate correction path may be generated (consistent with the connection constraint value selected at step 850) and the energy for that path may be calculated. If a minimum-energy correction path for the selected constraint has not been determined at step 854, step 852 is repeated to identify an additional candidate correction path for the given constraint. If a minimum-energy correction path for the selected constraint has been determined, the process proceeds to step 856.

The candidate correction path of step 852 may be generated in a number of ways. In certain embodiments, the correction path generated at step 852 may be generated randomly or semi-randomly (e.g., using a guess-and-check method). In other embodiments, correction paths may be generated algorithmically, for example using methods known to those of skill in the art, including, but not limited to, the balanced tangential method, the minimum curvature method, and the natural curve method.

In generating candidate correction paths at step 852, the process may optionally select from one or more well-known template curves. For example, the process may use one (or combine more than one) of a catenary curve, a clothoid curve, a circular arc, or a spline curve. A catenary curve models the path of a hanging cable under its own weight when supported only at its ends—defined mathematically as $y=\alpha \cos h(x/a)$, where a is a scaling value of the curve—and may be well-adapted for extended-reach drilling applications where the length of the total drill string is long relative to the length of the casing joint. A clothoid curve is a spiral curve where the rate of curvature increases linearly from zero to a desired curvature with respect to the arc length. A circular arc is a curve with a constant rate of curvature. A spline is a piecewise-defined polynomial function that possesses a high degree of smoothness at the connection points ("knots"). A spline curve may be well-adapted for ensuring smooth connection points between the actual drilling path 706, the correction drilling path generated in step 852, the planned drilling path 708, and any intermediate connection points along the correction drilling paths (e.g., where a catenary curve joins a clothoid curve).

The evaluation at step 854—of whether a minimum-energy correction path for the selected constraint has been determined—may be performed in a number of ways. In certain embodiments, the iteration loop of steps 852 and 854 may repeat a set number of times and the lowest-energy candidate correction path from step 852 may be determined to be the minimum-energy correction path. In other embodiments, the minimum-energy correction path may be algorithmically determined, for example by repeating the iteration sub-loop of steps 852 and 854 until converging on a minimum-energy correction path; in such embodiments, a maximum number of iterations may optionally be set. Where the correction constraint values selected at step 850 specify a total deviation length, mathematically, only one minimum-energy correction path for that total deviation length may exist (although other correction constraints may eliminate that minimum-energy correction path as a viable correction path). Thus, an algorithmic approach may be designed to converge toward that one minimum-energy correction path, to the extent it is consistent with other correction constraints.

By way of example of the embodiment of FIG. 8: the correction constraints of step 610 may require a total deviation length of between 100 and 1000 feet and a maximum rate of curvature of 10 degrees per 100 feet. A first loop iteration may begin at step 850 by selecting a total deviation length of 100 feet. The sub-loop of steps 852 and 854 may then iterate to generate a number of candidate connection paths, all having total deviation length of 100 feet and maximum rate of curvature of 10 degrees per 100 feet. At step 856, the lowest energy of those candidate connection paths may be identified as the minimum-energy correction path having total deviation length of 100 feet. Step 858 may then initiate a second iteration, beginning again at step 850 by selecting a new total deviation length of 110 feet. The sub-loop of steps 852 and 854 may then iterate to identify the minimum-energy correction path with total deviation length 110 feet (and maximum rate of curvature of 10 degrees per 100 feet) at step 856. Step 858 may then initiate a third iteration to identify the minimum-energy correction path with total deviation length 120 feet. The process may thus successively iterate until minimum-energy correction paths have been generated for the full range of possible deviation lengths. Then, at step 858, a final lowest minimum-energy is identified from among the various minimum-energy correction paths generated in the prior iterations (i.e., from among the 100-foot total deviation path, the 110-foot total deviation path, etc.). That final lowest minimum-energy path is provided at step 860 to trajectory correction step 614.

The evaluation at step 858—of whether a final minimum-energy correction path has been determined—may be performed in a number of ways. In certain embodiments, such as the example of the previous paragraph, the loop of steps 850 through 858 may be repeated by incrementing the correction constraint value selected at step 850 until minimum-energy correction paths have been identified for the full range of correction constraints. Using the example of a total deviation constraint ranging from 100 to 1000 feet, the loop may increment by 10 feet each iteration and repeat until every value from 100 to 1000 feet has been evaluated. In other embodiments, the loop may use random or pseudo-random (e.g., guess-and-check) selection of constraints and may optionally repeat a set number of times. In still other embodiments, the final minimum-energy correction path may be determined algorithmically, for example by repeating the loop until converging on a minimum-energy correction path; in such embodiments, a maximum number of iterations may optionally be set. In any of the above-mentioned embodiments, the final minimum-energy correction path used for step 860 may be the lowest of the minimum-energy correction paths identified across the various iterations that meets all correction constraints.

In certain embodiments, correction of well-path deviations may be entirely automated without manual intervention. This may be achieved, for example, by storing processes such as those illustrated in FIGS. 6 and 8 on firmware in the bottom hole assembly with pre-defined connection constraints. In other embodiments, the well-path correction may be assisted by manual operation. For example, a wellsite operator may be notified of any identified deviations from the planned drilling and prompted to provide correction constraints. In either set of embodiments, if no possible correction path is identified that meets the correction constraints, the operator may be notified to provide alternative correction constraints or perform other remedial action.

In certain embodiments, the approach to correcting well-path deviation may vary based on the amount of deviation from the planned path. For example, a specified tolerance range of deviation may be acceptable without need for correction. Additionally or alternatively, deviations below a set threshold may be corrected using conventional means, such as PID-type adjustment, while deviations above that threshold may be corrected according to the methods of the present disclosure.

Accordingly, the disclosed embodiments present a system, computer-implemented method, and computer-program product that modifies or replaces the conventional PID controller to implement a minimum wellbore energy method for performing automated wellbore trajectory control for correcting between an actual wellbore trajectory path and a planned wellbore trajectory path.

While specific details about the above embodiments have been described, the above hardware and software descriptions are intended merely as example embodiments and are not intended to limit the structure or implementation of the disclosed embodiments. For example, although many other internal components of the control system 100 are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer-program products according to various embodiments of the present invention. It should also be noted that, in some alternative implementations, the functions noted in the block may occur out of the order noted in the figures and as described herein. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In addition to the embodiments described above, many examples of specific combinations are within the scope of the disclosure, some of which are detailed in the below.

An embodiment is a computer-implemented method for performing automated wellbore trajectory control for correcting between an actual wellbore trajectory path and a planned wellbore trajectory path. The method may comprise receiving real-time path data for determining the actual wellbore trajectory path; receiving parameters for the planned wellbore trajectory path; determining whether the actual wellbore trajectory path deviates from the planned wellbore trajectory path; responsive to a determination that the actual wellbore trajectory path deviates from the planned wellbore trajectory path, determining a correction path using correction constraints; and initiating the wellbore trajectory control to change the actual wellbore trajectory path to the correction path.

Determining the correction path may further include generating a plurality of correction paths that satisfy the correction constraints and selecting the correction path with the lowest minimum incremental wellbore energy from among the plurality of correction paths. Generating one or more correction paths may optionally include selecting at least one correction constraint values and, for each of the at least one correction constraint values, generating a plurality of candidate correction paths using the correction constraint value and selecting the correction path with the lowest minimum incremental wellbore energy from among the plurality of candidate correction paths. The one or more correction constraint values may optionally be total deviation lengths.

In certain embodiments, the correction constraints may include a maximum rate of curvature and/or a maximum total deviation length. The correction constraints may optionally further include a maximum lateral deviation and/or a maximum depth deviation.

In certain embodiments, the correction path may include at least one of a clothoid curve, a catenary curve, a spline, and/or a circular arc. Optionally, the correction path may combine two different curves, such as clothoid curves, catenary curves, splines, and/or circular arcs.

An embodiment is a non-transitory computer readable medium including computer executable instructions for performing automated wellbore trajectory control for correcting between an actual wellbore trajectory path and a planned wellbore trajectory path. The computer executable instructions, when executed, may cause one or more machines to perform operations including receiving real-time path data for determining the actual wellbore trajectory path; receiving parameters for the planned wellbore trajectory path; determining whether the actual wellbore trajectory path deviates from the planned wellbore trajectory path; responsive to a determination that the actual wellbore trajectory path deviates from the planned wellbore trajectory path, determining a correction path using correction constraints; and initiating the wellbore trajectory control to change the actual wellbore trajectory path to the correction path.

In certain embodiments, the operations for determining the correction path may further include generating a plurality of correction paths that satisfy the correction constraints and selecting the correction path with the lowest minimum incremental wellbore energy from among the plurality of correction paths. The operations for generating one or more correction paths may optionally include selecting at least one correction constraint values and, for each of the at least one correction constraint values, generating a plurality of candidate correction paths using the correction constraint value and selecting the correction path with the lowest minimum incremental wellbore energy from among the plurality of candidate correction paths. The one or more correction constraint values may optionally be total deviation lengths.

In certain embodiments, the correction constraints may further include a maximum total deviation length. Additionally or alternatively, the correction path may include at least one of a clothoid curve, a catenary curve, a spline, and/or a circular arc. Optionally, the correction path may include a combination of two different curves, such as clothoid curves, catenary curves, splines, and/or circular arcs.

An embodiment is a controller for performing automated wellbore trajectory control for correcting between an actual wellbore trajectory path and a planned wellbore trajectory path. The controller may include at least one processor and at least one memory coupled to the at least one processor. The memory may store instructions that, when executed by the at least one processor, performs operations including receiving real-time path data for determining the actual wellbore trajectory path; receiving parameters for the planned wellbore trajectory path; determining whether the actual wellbore trajectory path deviates from the planned wellbore trajectory path; responsive to a determination that the actual wellbore trajectory path deviates from the planned wellbore trajectory path, determining a correction path using correction constraints; and initiating the wellbore trajectory control to change the actual wellbore trajectory path to the correction path.

In certain embodiments, the operations for determining the correction path may further comprise generating a plurality of correction paths that satisfy the correction constraints and selecting the correction path with the lowest minimum incremental wellbore energy from among the plurality of correction paths. The operations for generating one or more correction paths may optionally further include selecting at least one correction constraint values and, for each of the at least one correction constraint values, generating a plurality of candidate correction paths using the correction constraint value and selecting the correction path with the lowest minimum incremental wellbore energy from among the plurality of candidate correction paths. In certain embodiments, the correction path may include at least one clothoid curve, catenary curve, spline, and/or circular arc.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described to explain the principles of the invention and the practical application, and to enable others of ordinary skill in the art to understand the invention for various embodiments with various modifications as are suited to the particular use contemplated. The scope of the claims is intended to broadly cover the disclosed embodiments and any such modification.

What is claimed is:

1. A computer-implemented method for performing automated wellbore trajectory control for correcting between an actual wellbore trajectory path and a planned wellbore trajectory path, the method comprising:

receiving real-time path data for determining said actual wellbore trajectory path; receiving parameters for said planned wellbore trajectory path;

determining a trend angle and a deviation vector length between the planned wellbore trajectory path and the actual wellbore trajectory path based on the parameters;

determining whether said actual wellbore trajectory path deviates from said planned wellbore trajectory path based on the trend angle and the deviation vector length;

responsive to a determination that said actual wellbore trajectory path deviates from said planned wellbore trajectory path, obtaining correction constraints for a correction path, wherein the correction constraints specify limits on the correction path, wherein the correction constraints specify a maximum rate of inclination change, a maximum rate of azimuth change, and further specify at least one of a maximum or a minimum length of deviation from the planned wellbore trajectory path, wherein the length of deviation from the planned wellbore trajectory path is specified in terms of one or more of a vertical depth deviation, a lateral deviation, and a total deviation, wherein the correction constraints are based, at least in part, on the real-time path data, and wherein the correction path is based, at least in part, on a normalized wellbore energy;

determining trajectory correction parameters for the correction path that has a minimum normalized wellbore energy satisfying the obtained correction constraints, wherein the normalized wellbore energy is based, at least in part, on a borehole torsion and a wellbore curvature, wherein the trajectory correction parameters comprise a rate of inclination change, a rate of azimuth change and a change in measured depth;

updating the correction path based on the trajectory correction parameters; and initiating said wellbore trajectory control to change said actual wellbore trajectory path to the updated correction path.

2. The computer-implemented method of claim 1, further comprising determining said correction path by:

generating a plurality of correction paths that satisfy said correction constraints; and selecting the correction path with the lowest minimum incremental wellbore energy from among said plurality of correction paths.

3. The computer-implemented method of claim 2, wherein generating the plurality of correction paths further comprises:

selecting one or more correction constraint values; and for each of said one or more correction constraint values:

generating a plurality of candidate correction paths using said correction constraint value; and wherein selecting the correction path comprises selecting the correction path with the lowest minimum incremental wellbore energy from among the plurality of candidate correction paths.

4. The computer-implemented method of claim 3, wherein said one or more correction constraint values are total deviation lengths.

5. The computer-implemented method of claim 1, wherein said correction constraints comprise a maximum rate of curvature.

6. The computer-implemented method of claim 5, wherein said correction constraints further comprise a maximum total deviation length.

7. The computer-implemented method of claim 6, wherein said correction constraints further comprise at least one of a maximum lateral deviation and a maximum depth deviation.

8. The computer-implemented method of claim 1, wherein said correction path comprises at least one curve from the set of: clothoid curve, catenary curve, spline, and circular arc.

9. The computer-implemented method of claim 8, wherein said correction path comprises a combination of two different curves from the set of: clothoid curve, catenary curve, spline, and circular arc.

10. A non-transitory computer readable medium comprising computer executable instructions for performing automated wellbore trajectory control for correcting between an actual wellbore trajectory path and a planned wellbore trajectory path, said computer executable instructions when executed causing one or more machines to perform operations comprising:

receiving real-time path data for determining said actual wellbore trajectory path; receiving parameters for said planned wellbore trajectory path;

determining a trend angle and a deviation vector length between the planned wellbore trajectory path and the actual wellbore trajectory path based on the parameters;

determining whether said actual wellbore trajectory path deviates from said planned wellbore trajectory path based on the trend angle and the deviation vector length;

responsive to a determination that said actual wellbore trajectory path deviates from said planned wellbore trajectory path obtaining, correction constraints for a correction path, wherein the correction constraints specify limits on the correction path, wherein the correction constraints specify a maximum rate of inclination change, a maximum rate of azimuth change, and further specify at least one of a maximum or a minimum length of deviation from the planned wellbore trajectory path, wherein the length of deviation from the planned wellbore trajectory path is specified in terms of one or more of a vertical depth deviation, a lateral deviation, and a total deviation, wherein the correction constraints are based, at least in part, on the real-time path data, and wherein the correction path is based, at least in part, on a normalized wellbore energy;

determining trajectory correction parameters for the correction path that has a minimum normalized wellbore energy satisfying the obtained correction constraints, wherein the normalized wellbore energy is based, at least in part, on a borehole torsion and a wellbore curvature, wherein the trajectory correction parameters comprise a rate of inclination change, a rate of azimuth change and a change in measured depth;

updating the correction path based on the trajectory correction parameters; and initiating said wellbore trajectory control to change said actual wellbore trajectory path to the updated correction path.

11. The computer readable medium of claim 10, wherein said operations further comprise determining said correction path by:

generating a plurality of correction paths that satisfy said correction constraints; and selecting the correction path with the lowest minimum incremental wellbore energy from among said plurality of correction paths.

12. The computer readable medium of claim 11, wherein said operations for generating the plurality of correction paths comprise:

selecting one or more correction constraint values;

for each of said one or more correction constraint values:

generating a plurality of candidate correction paths using said correction constraint value; and wherein selecting the correction path comprises selecting the correction path with the lowest minimum incremental wellbore energy from among said plurality of candidate correction paths.

13. The computer readable medium of claim 12, wherein said one or more correction constraint values are total deviation lengths.

14. The computer readable medium of claim 10, wherein said correction constraints further comprise a maximum total deviation length.

15. The computer readable medium of claim 10, wherein said correction path comprises at least one curve from the set of: clothoid curve, catenary curve, spline, and circular arc.

16. The computer readable medium of claim 15, wherein said correction path comprises a combination of two different curves from the set of: clothoid curve, catenary curve, spline, and circular arc.

17. A controller for performing automated wellbore trajectory control for correcting between an actual wellbore trajectory path and a planned wellbore trajectory path, said controller comprising:

at least one processor; and at least one memory coupled to said at least one processor and storing instructions that when executed by said at least one processor performs operations comprising:

receiving real-time path data for determining said actual wellbore trajectory path;

receiving parameters for said planned wellbore trajectory path; determining a trend angle and a deviation vector length between the planned wellbore trajectory path and the actual wellbore trajectory path based on the parameters;

determining whether said actual wellbore trajectory path deviates from said planned wellbore trajectory path based on the trend angle and the deviation vector length;

responsive to a determination that said actual wellbore trajectory path deviates from said planned wellbore trajectory path obtaining correction constraints for a correction path, wherein the correction constraints specify limits on the correction path, wherein the correction constraints specify a maximum rate of inclination change, a maximum rate of azimuth change, and further specify at least one of a maximum or a minimum length of deviation from the planned wellbore trajectory path, wherein the length of deviation from the planned wellbore trajectory path is specified in terms of one or more of a vertical depth, a lateral deviation, and a total deviation, wherein the correction constraints are based, at least in part, on the real-time path data;

determine trajectory correction parameters for the correction path that has a minimum normalized wellbore energy satisfying the obtained correction constraints, wherein the normalized wellbore energy is based, at least in part, on a borehole torsion and a wellbore curvature, wherein the trajectory correction parameters comprise a rate of inclination change, a rate of azimuth change and a change in measured depth;

update the correction path based on the trajectory correction parameters; and initiating said wellbore trajectory control to change said actual wellbore trajectory path to the updated correction path.

18. The controller of claim 17, wherein said operations further comprise determining said correction path by:

generating a plurality of correction paths that satisfy said correction constraints; and selecting the correction path with the lowest minimum incremental wellbore energy from among said plurality of correction paths.

19. The controller of claim 18, wherein said operations for generating the plurality of correction paths further comprise:

selecting one or more correction constraint values;

for each of said one or more correction constraint values:

generating a plurality of candidate correction paths using said correction constraint value; and wherein selecting the correction path comprises selecting the correction path with the lowest minimum incremental wellbore energy from among said plurality of candidate correction paths.

20. The controller of claim 17, wherein said correction path comprises at least one curve from the set of: clothoid curve, catenary curve, spline, and circular arc.

* * * * *